US007439949B2

(12) United States Patent
Shikina et al.

(10) Patent No.: US 7,439,949 B2
(45) Date of Patent: Oct. 21, 2008

(54) DISPLAY APPARATUS IN WHICH RESET OR SIGNAL VOLTAGES IS CORRECTED FOR RESIDUAL DC VOLTAGE AND DRIVING METHOD FOR THE SAME

(75) Inventors: Noriyuki Shikina, Yokohama (JP); Hideo Mori, Yokohama (JP); Hideki Yoshinaga, Yokohama (JP); Tatsuhito Goden, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 690 days.

(21) Appl. No.: 10/793,708

(22) Filed: Mar. 4, 2004

(65) Prior Publication Data

US 2004/0227720 A1 Nov. 18, 2004

(30) Foreign Application Priority Data

Mar. 5, 2003 (JP) ..... 2003-058562

(51) Int. Cl.
*G09G 3/34* (2006.01)

(52) U.S. Cl. ..... 345/107; 345/99; 345/210; 345/211

(58) Field of Classification Search ..... 345/87–107, 345/204–215, 690–699
See application file for complete search history.

(56) References Cited

U.S. PATENT DOCUMENTS 3,612,758 A 10/1971 Evans et al.
5,798,740 A * 8/1998 Bitzakidis et al. ..... 345/92
6,219,017 B1 * 4/2001 Shimada et al. ..... 345/88
6,501,451 B1 * 12/2002 Sakashita ..... 345/87
6,556,180 B1 * 4/2003 Furuhashi et al. ..... 345/87
6,791,525 B2 * 9/2004 Matsumura et al. ..... 345/100
2002/0005832 A1 1/2002 Katase
2002/0021483 A1 2/2002 Katase
2003/0137521 A1 7/2003 Zehner et al.

* cited by examiner

*Primary Examiner*—Vijay Shankar
(74) *Attorney, Agent, or Firm*—Morgan & Finnegan LLP

(57) ABSTRACT

A display apparatus includes a matrix display panel including scanning lines and signal lines disposed so as to form pixels each at an intersection of the scanning and signal lines, and a drive circuit for applying a voltage to the scanning and signal lines, the drive circuit generates a signal voltage depending on an image data inputted externally and applies the signal voltage to the signal lines while sequentially applying a selection voltage to the scanning line to effect writing of an image in the display panel. The drive circuit has a correction function of correcting a signal voltage depending on an image data in current image writing, at the time of image writing to the display panel, on the basis of a signal voltage in preceding image writing and an elapsed time from the preceding image writing, thereby to apply the corrected signal voltage to the signal lines.

13 Claims, 7 Drawing Sheets

DISPLAY APPARATUS IN WHICH RESET OR SIGNAL VOLTAGES IS CORRECTED FOR RESIDUAL DC VOLTAGE AND DRIVING METHOD FOR THE SAME

FIELD OF THE INVENTION AND RELATED ART

The present invention relates to a display apparatus and a driving method of the display apparatus.

With development of information equipment, the needs for low-power and thin display apparatuses have grown, so that extensive study and development have been made on display apparatuses fitted to these needs.

Such a display apparatus is used frequently outdoors particularly as a wearable PC (personal computer) or an electronic note pad, thus being desirable that it can reduce power consumption and save space. For this reason, e.g., such a product that a display function of a thin display such as a liquid crystal display and means for inputting coordinate data are integrated, and direct input can be effected by pressing a display item on a display surface with a stylus or finger, has been commercialized.

However, most of liquid crystal materials have no memory characteristic, so that it is necessary to continuously apply a voltage to the liquid crystal during a display period. On the other hand, a liquid crystal material having a memory function cannot readily ensure a reliability in the case of assuming its use in various environments such as outdoor environment as in the wearable PC, thus failing to be put into practical use.

In view of these circumstances, as one of thin and light display apparatuses, an electrophoretic display device has been proposed by Harold D. Lee et al. (U.S. Pat. No. 3,612,758).

This type of electrophoretic display device includes a pair of substrates disposed with a predetermined spacing therebetween, an insulating liquid filled in the spacing, a multiplicity of colored charged (migration) particles dispersed in the insulating liquid, and display electrodes disposed at each pixel along each substrate.

In this electrophoretic display device, the colored charged particles are electrically charged positively or negatively, so that they are adsorbed by either one of the display electrodes depending on a polarity of a voltage applied to the display electrodes. As a result, e.g., it becomes possible to display various images by controlling a state in which the colored charged particles are adsorbed by the upper electrode and are observed from a viewer side and a state in which the colored charged particles are adsorbed by the lower electrode, so that the color of the insulating liquid is visually identified. This type of the electrophoretic display device is referred to as a vertical movement type electrophoretic display device.

A driving method of an active matrix type electrophoretic display device utilizing the memory characteristic has been proposed in U.S. Laid-Open Applications 2002-021483 and 2002-005832. In this driving member, a reset voltage is written in each pixel electrode in a reset period. Thereafter, in a writing operation period, a voltage is applied to each pixel electrode so that a certain voltage is applied in a specific period corresponding to a gradation level value given by an image data or that only a voltage corresponding to a gradation level value given by an image data is applied in a certain period. By doing so, electric charges stored in a pixel capacitor are discharged to cause an electric field to act on a dispersion system. Thereafter, a display image is retained.

In the driving method of display apparatus, when writing only depending on a gradation level value given by an image data is effected, display at a desired gradation level value cannot be effected in some cases. This may be attributable to a presence of DC voltage component remaining in a display device. More specifically, in some display apparatuses, a display state is determined depending on a polarity of applied voltage, so that a voltage of a one of positive and negative polarities is applied for driving a display device. In such a driving of the display apparatus, a DC voltage component remains in the display device, so that an applied voltage at the time of writing and an effective voltage applied to the display device cause a difference therebetween, thus failing to result in a desired gradation display level. This phenomenon due to the residual DC voltage component is referred to as "burning or burn-in".

Even in the above described electrophoretic display device, writing with one of the polarities of applied voltage is assumed since the colored charged particles are electrically charged to the positive or negative polarity. In this case, burning is caused to occur.

Hereinbelow, such a burning and residual DC voltage component will be described more specifically with reference to FIG. 2.

FIG. 2 shows an embodiment of a structure of the electrophoretic display device.

The electrophoretic display device includes positively charged black particles 21, negatively charged white particles 22, a dispersion liquid containing a liquid and a plurality of charged (migration) particles, electrodes comprising a first electrode 24 and a second electrode 25 for forming an electric field in the dispersion liquid under voltage application, an insulating layer 26 for separating the dispersion liquid from the first electrode 24, an insulating layer 27 for separating the dispersion liquid from the second electrode 25, and a partition wall 28 for partitioning adjacent pixels. In this type of electrophoretic display device, time constants for alleviating electric charges at respective portions are different from each other depending on physical properties of the respective structural members. Here, assuming that the time constant of the dispersion liquid portion is $\tau 1$ and the time constant of the insulating layer portion is $\tau 2$, satisfying $\tau 1 << \tau 2$, e.g., when a voltage of one of the positive and negative polarities is continuously applied between the first and second electrodes, electric charges remain even at both ends of the insulating layer portion where they do not readily remain since $\tau 2$ is large. Thereafter, even if 0 V is applied between the electrodes, the insulating layer portion also has a longer alleviation time for electric charges, so that the electric charges remains thereat for a long time. As a result, even though the electrodes are supplied with 0 V, an internal voltage due to the residual electric charges is generated at upper and lower ends of the dispersion liquid portion. The resultant voltage difference at that time is referred to as a residual DC voltage component. A voltage different from the applied voltage is applied between the upper and lower ends of the dispersion liquid portion by the residual DC voltage component, thus causing burning.

By this phenomenon, in the case where a writing operation is performed by making reference to only image information to be displayed, a desired voltage cannot be applied to a display device, thus failing to provide a desired display state.

SUMMARY OF THE INVENTION

In view of the above problem, an object of the present invention is to provide a display apparatus capable of providing good display state by taking the influence of residual DC voltage component into consideration.

Another object of the present invention is to provide a driving method of the display apparatus.

According to the present invention, there is provided a display apparatus, comprising:

a matrix display panel including scanning lines and signal lines disposed so as to form pixels each at an intersection of the scanning and signal lines, and a drive circuit for applying a voltage to the scanning and signal lines, the drive circuit generating a signal voltage depending on an image data inputted externally and applying the signal voltage to the signal lines while sequentially applying a selection voltage to the scanning line to effect writing of an image in the display panel, wherein the drive circuit has a correction function of correcting a signal voltage depending on an image data in current image writing, at the time of image writing to the display panel, on the basis of a signal voltage in preceding image writing and an elapsed time from the preceding image writing, thereby to apply the corrected signal voltage to the signal lines.

According to the present invention, there is also provided a driving method of a display apparatus which comprises a matrix display panel including scanning lines and signal lines disposed so as to form pixels each at an intersection of the scanning and signal lines, and a drive circuit for applying a voltage to the scanning and signal lines;

the driving method comprising:

a step of generating a signal voltage depending on an image data inputted externally in the drive circuit, and a step of effecting image writing to the display panel by applying the signal voltage to the signal lines while sequentially applying a selection voltage to the scanning line to effect writing of an image in the display panel, to the display panel, wherein such an image writing step includes a step of correcting a signal voltage in current image writing, at the time of image writing to the display panel, with reference to a signal voltage in preceding image writing and an elapsed time from the preceding image writing; and a a step applying the corrected signal voltage to the signal lines.

By the display apparatus and the driving method thereof according to the present invention, driving of a display device for writing a display image is performed depending on a writing history before the writing, so that it becomes possible to effect writing in view of the influence of a residual DC voltage component remaining in the display device. As a result, a good display characteristic can be attained.

DETAILED DESCRIPTION OF THE PREFERRED EMBODIMENTS

In driving of a display apparatus wherein display sate is determined depending on a polarity of applied voltage, a positively or negatively biased voltage is applied in a writing period. As a result, a DC voltage component remains in a display device even when a voltage applied between electrodes is 0 V by establishing a short circuit in pixel electrode. In the present invention, such a DC voltage component is intended to be constant irrespective of preceding written image(s). More specifically, when current writing is performed, with reference to preceding writing history, a writing voltage is corrected so that the residual DC voltage component is regarded as substantially constant to the extent that it does not adversely affect a display state. Further, as the preceding writing history, at least one of information including drive information of preceding N times, elapsed time information from immediately preceding drive, and display state information in current drive is used as reference information.

Hereinbelow, an embodiment of the driving method of a display apparatus according to the present invention will be described while taking an electrophoretic display device as an example of the display apparatus. However, the display apparatus of the present invention is not limited to the electrophoretic display device but is applicable to display apparatuses using, e.g., a polymer network liquid crystal and a ferroelectric liquid crystal.

The driving method of the present invention is applicable to both of the vertical movement type electrophoretic display device and horizontal movement type electrophoretic display device.

In such an electrophoretic display devices, the charged particles and the dispersion medium may be encapsulated in each of a number of microcapsules.

Embodiment 1

Figure 1:
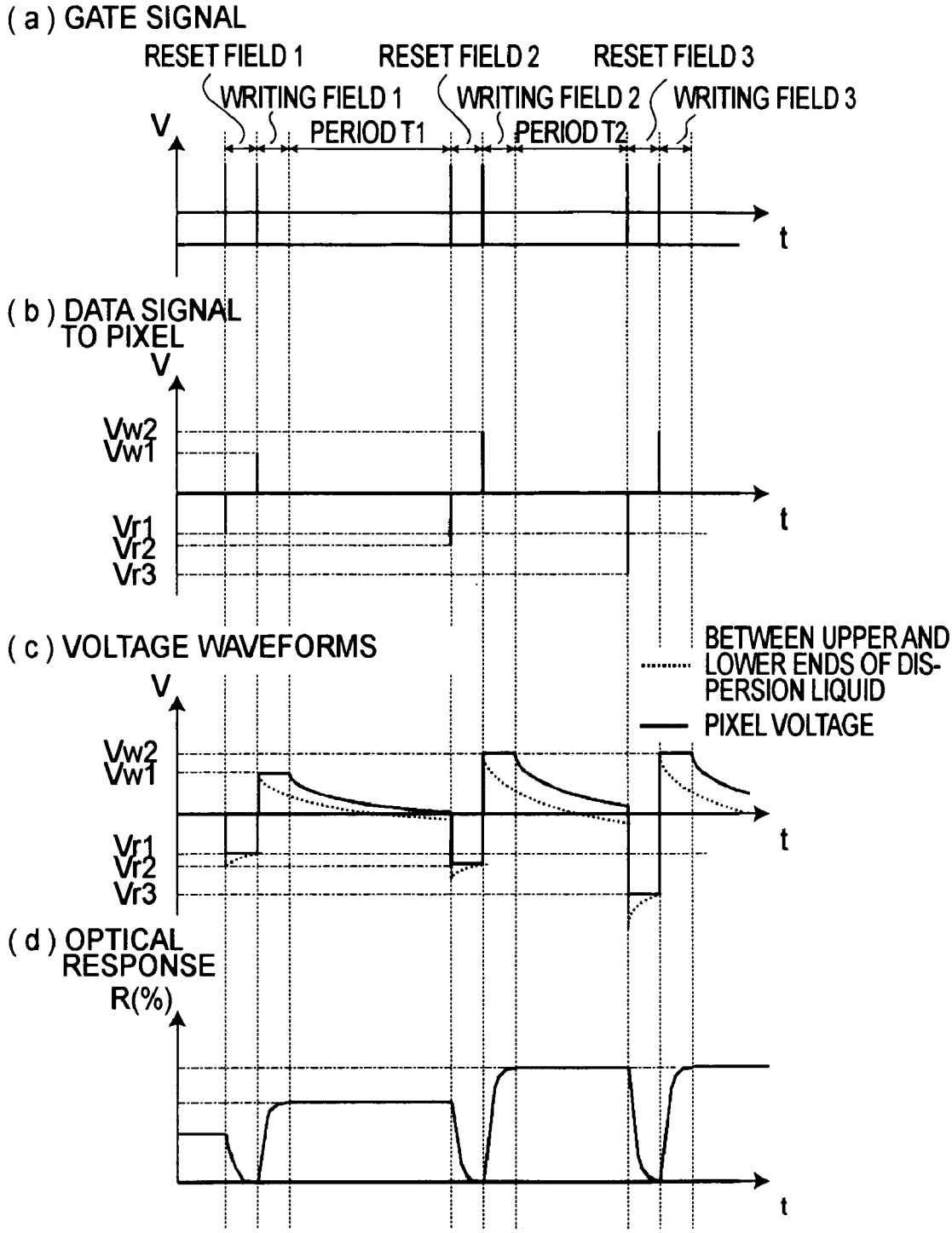
FIGS. 1(*a*) to 1(*d*) are views for illustrating signal waveforms and optical response with respect to a certain (one) pixel of an electrophoretic display device used in the present invention.
Figure 3:
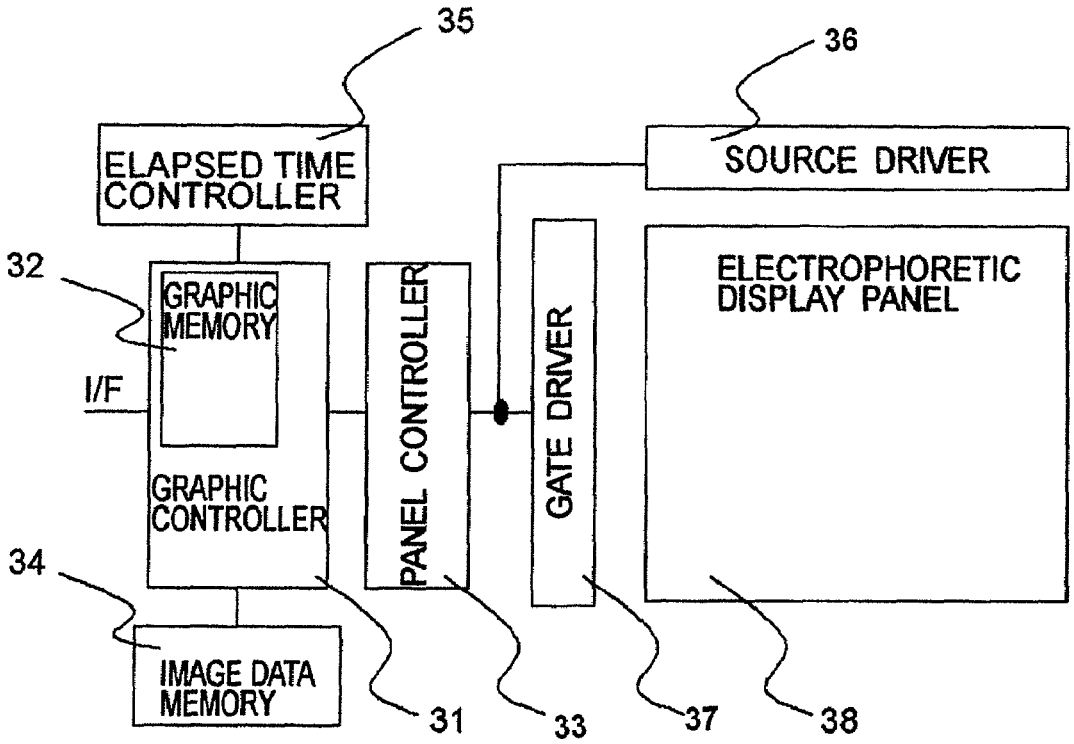
FIG. 3 is a drive system black diagram of the display apparatus according to the present invention.

FIG. 1 shows signal voltage waveforms applied to a display apparatus of this embodiment, and an optical response of a display element. FIG. 3 shows a block diagram for illustrating a system using an electrophoretic display panel as a display panel.

As shown in FIG. 3, the display apparatus includes an electrophoretic display panel 38 as a display panel, a graphic controller 31 as a drive circuit, a graphic memory 32, a panel controller 33, an immediately preceding image information memory 34, a controller 35 of elapsed time from display of immediately preceding image, a source driver 36, and a gate driver 37.

The graphic controller 31 creates an output data on the basis of image data of the graphic memory 32, image data of the immediately preceding image information memory 34, and data of the controller 35 of elapsed time from display of immediately preceding image, and outputs the output data to the panel controller 33 in accordance with information transfer clock.

The panel controller 33 creates control signals such as a field synchronizing signal, a horizontal synchronizing signal and a data acquisition signal, and display data on the basis of the image data inputted from the graphic controller 31.

The source driver 36 and the gate driver 37 output a drive voltage to an electrophoretic display panel 38 in accordance with the control signals and the display data received from the panel controller 33, thus effecting display.

Figure 4:
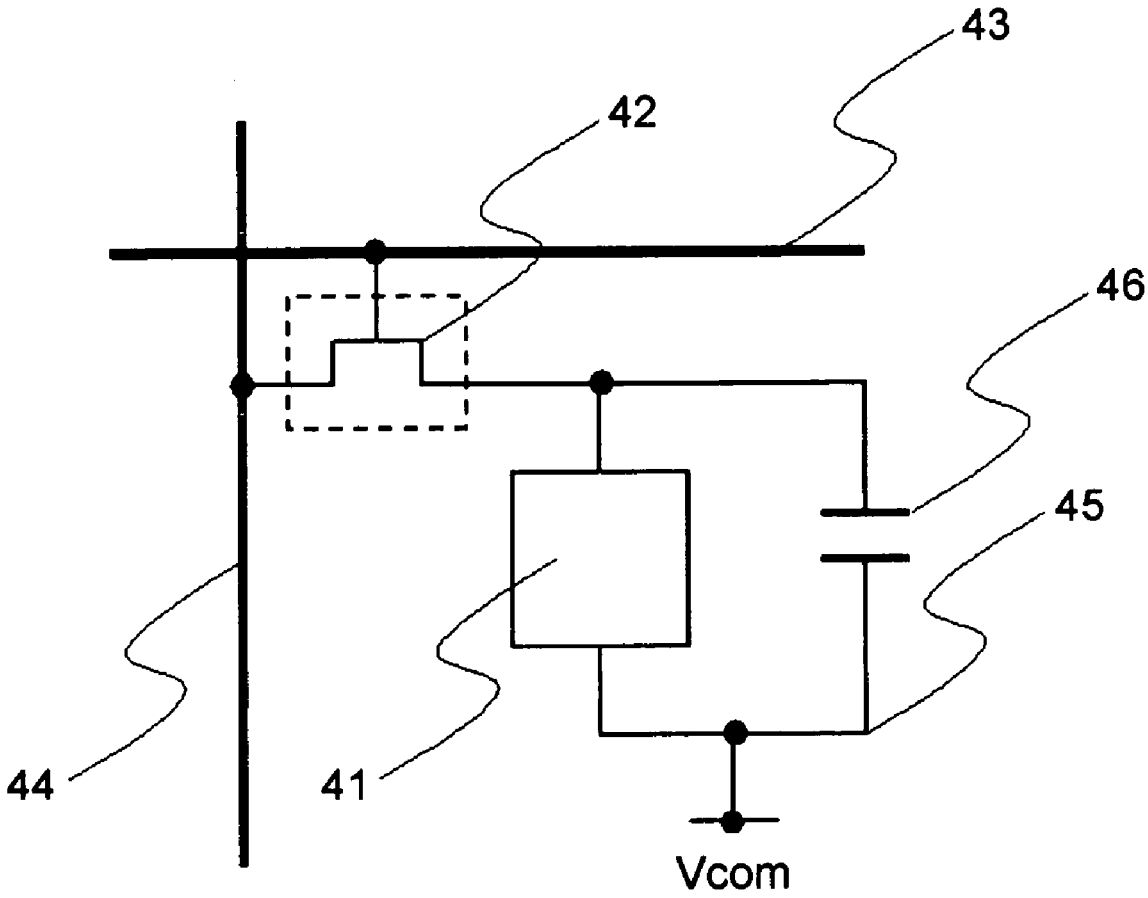
FIG. 4 is a view for illustrating one pixel portion of a display panel of the display apparatus of the present invention.

A wiring (circuit) diagram of one pixel of the electrophoretic display panel 38 is shown in FIG. 4. Referring to FIG. 4, a first electrode of an electrophoretic display device 41 is connected to a drain electrode of a TFT (thin film transistor) 42 for display according to active matrix drive, and a second electrode is connected to a common electrode 45 having a voltage Vcom. The second electrodes of all the pixels are connected to the common electrode 45. A gate line 43 is connected to a gate electrode of the TFT and a source line 44 is connected to a source electrode of the TFT.

Figure 2:
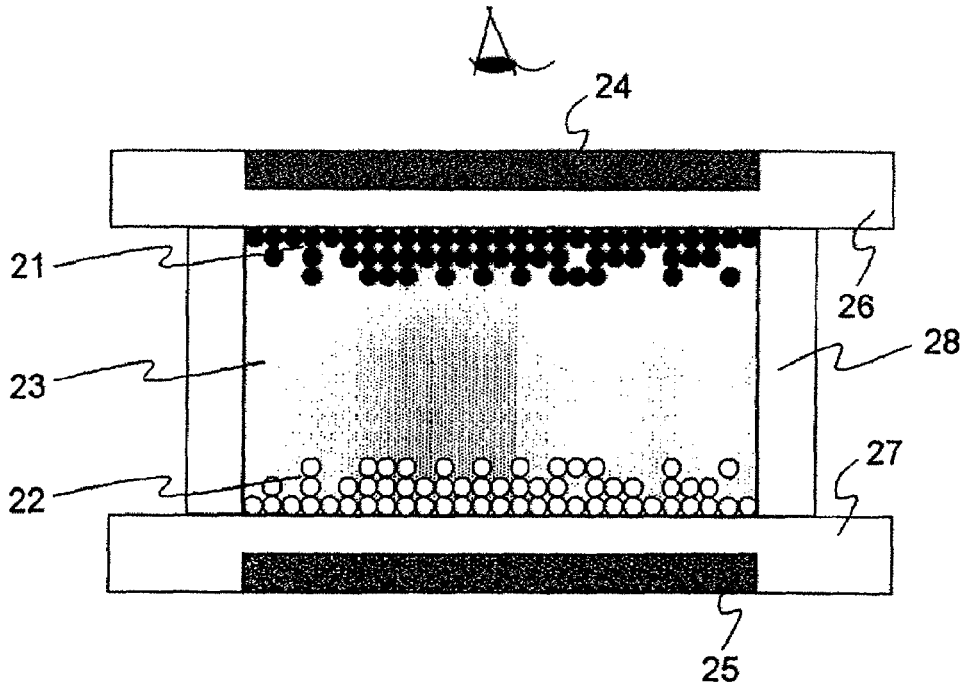
FIG. 2 is a schematic sectional view of one pixel portion of the electrophoretic display device.

FIG. 2 shows a sectional view of one pixel portion of the electrophoretic display panel of this embodiment.

The display panel includes positively charged black particles 21, negatively charged white particles 22, a dispersion liquid containing a liquid and a plurality of charged (migration) particles, electrodes comprising a first electrode 24 and a second electrode 25 for forming an electric field in the dispersion liquid under voltage application, an insulating layer 26 for separating the dispersion liquid from the first electrode 24, an insulating layer 27 for separating the dispersion liquid from the second electrode 25, and a partition wall 28 for partitioning adjacent pixels.

Figure 5:
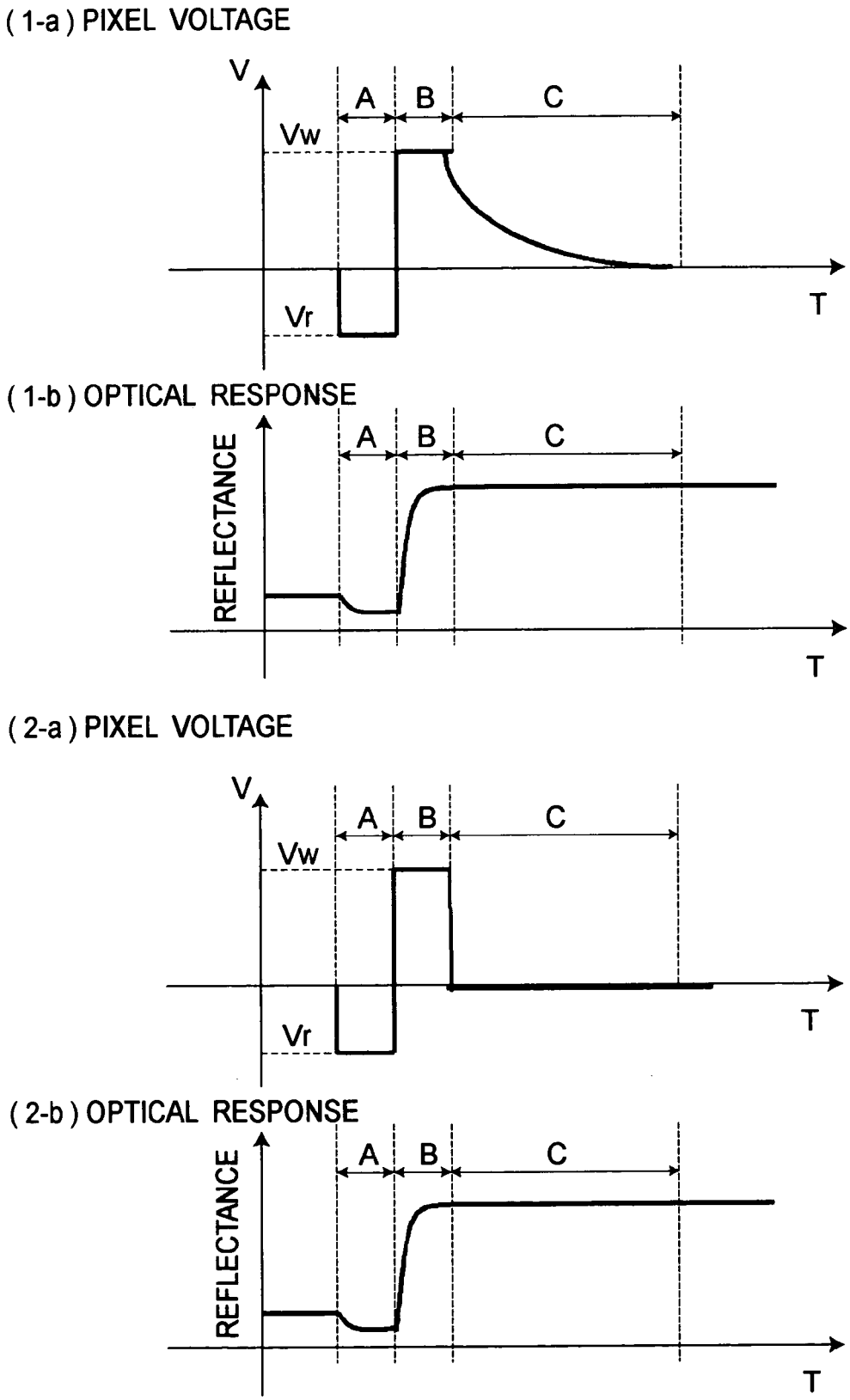
FIGS. 5(1-*a*) to 5(2-*b*) are views for illustrating a pixel electrode waveform applied to one pixel and an optical response thereof.

FIG. 5(1-*a*) shows a pixel electrode voltage waveform at a certain (one) pixel of the electrophoretic display panel 38 ad FIG. 5(1-*b*) shows a corresponding optical response. In FIG. 5, A represents a reset period, B represents a writing period, C represent a period in which electric charges stored in a storage (holding) capacitor are dissipated. A period preceding to the reset period A may be regarded as such a period that a display state in preceding image writing is shown. In the reset period A, the preceding display state is reset by applying a reset voltage Vr. Then, in the writing period B, the electrophoretic display device is driven by applying thereto a writing voltage Vw. A desired gradation level can be attained by controlling a magnitude of the writing voltage Vw.

In the case where writing memory is already completed in the writing period B, the pixel electrode may be supplied with 0 V in the period C. In this case, a pixel electrode voltage waveform is shown in FIG. 5(2-*a*) and a corresponding optical response is shown in FIG. 5(2-*b*).

Figure 6:
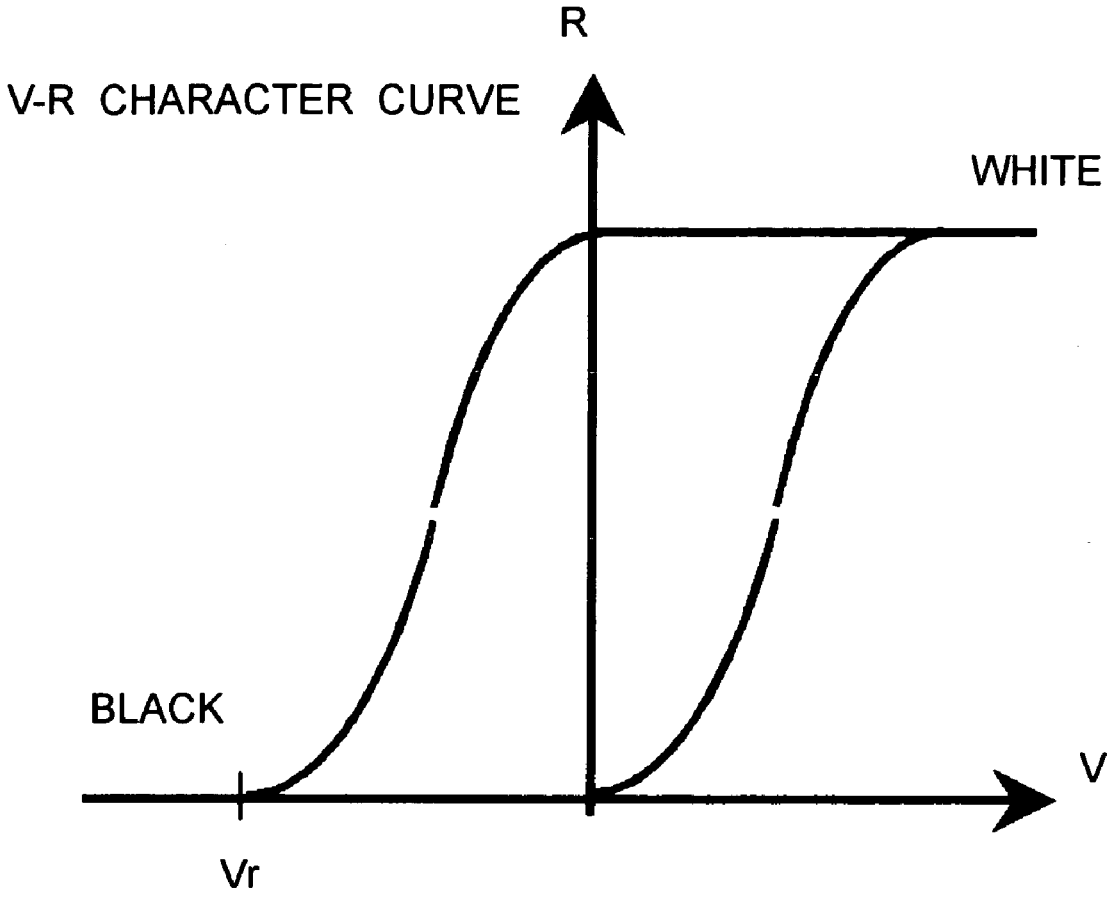
FIG. 6 is a graph showing a voltage-optical response (transmittance) of the display panel used in the display apparatus of the present invention.

An optical response characteristic of the electrophoretic display device of this embodiment is shown in FIG. 6. Referring to FIG. 6, when reset of the display state is performed by placing it in a black state, a reset voltage Vr is required for resetting any display state to the black state. However, depending on a writing history before this resetting operation, variations in residual DC voltage component value at each pixel is caused to occur. In this case, when the reset voltage Vr is applied to all the pixels, the variations in residual DC voltage component value at each pixel remain result. By this variations in residual DC voltage component, there is a possibility that a desired gradation display cannot be attained even if a writing voltage Vw is applied.

In this embodiment, a reset operation of the DC voltage component is effected by adjusting the reset voltage. In the above mentioned reset period A, at the time of resetting, not only particles at each pixel are uniformly placed in an initial (black) state but also the residual DC voltage component value at each pixel is uniformly set to a certain value.

Hereinbelow, specific driving method of the electrophoretic display device in this embodiment will be described.

Figure 7:
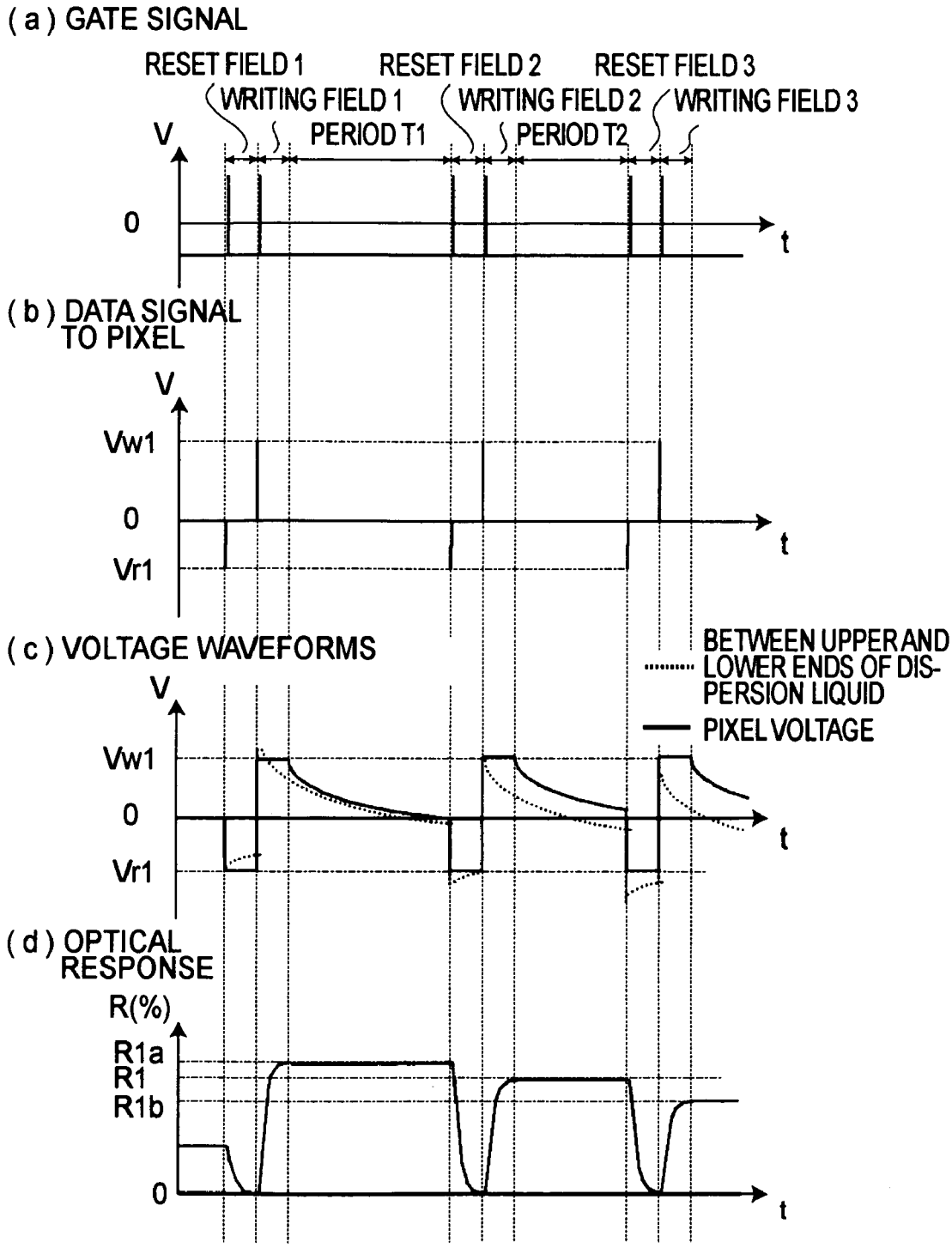
FIGS. 7(*a*) to 7(*d*) are views for illustrating signal waveforms and optical response with respect to a certain pixel of an electrophoretic display device in the case where correction of a residual DC voltage component is not effected.

Signal waveforms and optical response with respect to a certain (one) pixel of the electrophoretic display panel 38 in the case where the correction operation (drive) of the residual DC voltage component is not effected are shown in FIG. 7, wherein a scanning signal pulse inputted from the gate driver is shown in FIG. 7(*a*), an information (data) signal pulse inputted from the source driver to the pixel is shown in FIG. 7(*b*), a pixel electrode voltage waveform an a voltage waveform applied between upper and lower ends of the dispersion liquid at the pixel are shown in FIG. 7(*c*), and a corresponding optical response is shown in FIG. 7(*d*).

First of all, in a reset field 1, a reset pulse voltage vr1 is applied from the source driver in synchronism with the gate pulse. Therefore, in a writing field 1, Vw is applied to effect writing. Then, in a period T1, the voltage is gradually attenuated. In this embodiment, this attenuation is caused by gradual dissipation of electric charges due to OFF resistance of the TFT. Similarly, vr2 is applied in a reset field 2, Vw2 is applied in a writing field 2, and the voltage is gradually attenuated in a period T2. A similar operation is repeated also with respect to Vr3, Vw3 and T3.

In this case, as shown in FIG. 7(*c*), at the time of start of the respective writing field, variations in voltage value applied between upper and lower ends of the dispersion liquid portion are found. The variations are attributable to the residual DC voltage component. Due to the variations, a desired signal cannot be applied between upper and lower ends of the dispersion liquid portion. As a result, a desired gradation level cannot be attained. In this case, as shown in FIG. 7(*d*), the resultant display gradation levels are R1*a* and R1*b* relative to a desired gradation level R1.

Signal waveforms and optical response with respect to a certain (one) pixel of the electrophoretic display panel 38 in the case where the correction operation (drive) of the residual DC voltage component is effected by reset pulse control are shown in FIG. 1, wherein a scanning signal pulse inputted from the gate driver is shown in FIG. 1(*a*), an information (data) signal pulse inputted from the source driver to the pixel is shown in FIG. 1(*b*), a pixel electrode voltage waveform an a voltage waveform applied between upper and lower ends of the dispersion liquid at the pixel are shown in FIG. 1(*c*), and a corresponding optical response is shown in FIG. 7(*d*).

First of all, in a reset field 1, a reset pulse voltage vr1 is applied from the source driver in synchronism with the gate pulse. In this case, such an assumption that a positional state of the particles and a value of residual DC voltage component can also be controlled as constant state and value, respectively. Therefore, in a writing field 1, Vw is applied to effect writing. Then, in a period T1, the voltage is gradually attenuated. In this embodiment, this attenuation is caused by gradual dissipation of electric charges due to OFF resistance of the TFT. Similarly, vr2 is applied in a reset field 2, Vw2 is applied in a writing field 2, and the voltage is gradually attenuated in a period T2. A similar operation is repeated also with respect to Vr3, Vw3 and T3.

In this embodiment shown in FIG. 1, when the writing voltage Vw1, Vw2 and Vw3 are applied, desired gradation levels (reflectances) R1, R2 and R3, respectively, are set.

A pulse data is created through a computation by the graphic controller 31, in order to provide a uniform value of the residual DC voltage component, on the basis of image data of the immediately preceding image information memory 34 and data of the controller 35 of elapsed time from display of immediately preceding image, and is applied as a reset pulse voltage Vr(n) from the source driver through the panel controller 33. In other words, vr2 is determined on the basis of Vw1 and T1, and vr3 is determined on the basis of Vw2 and T2.

More specifically, the reset pulse voltage Vr(n) is determined according to the following equation:

$$Vr(n)=Vr+Vw(n-1)\times F\{T(n-1)\},$$

wherein Vr represents a voltage capable of resetting any display state to a black state, and F{T(n)} represents a function which is determined based on an actual measured value obtained through an experiment, i.e., a function of elapsed time T(n).

For example, vr2 and vr3 are represented by the following equations.

$$Vr2=Vr+Vw1\times F\{T1\}$$

$$Vr3=Vr+Vw2\times F\{T2\}$$

The pulse data for the reset pulse voltage Vr(n) may be determined by using a data conversion table prepared through experimental data. For example, by the use of the data conversion table, Vr2 is determined by reference to Vw1 and T1, and vr3 is determined by reference to Vw2 and T2.

As described above, the correction of residual DC voltage component using the reset voltage is effected in such a manner that a correction voltage which is determined by the product of an immediately preceding writing voltage and a predetermined function of attenuation time of TFT driving voltage after the writing, is added to a standard reset voltage capable of resetting any display state to a black state. At each pixel immediately after the corrected reset pulse voltage is applied, the value of residual DC voltage component is uniformized as a constant value, so that it is possible to effect a gradation display, which is not adversely affected by the residual DC voltage component, by applying a predetermined writing voltage in a subsequent writing field.

In order to enhance an accuracy of the reset pulse voltage Vr(n), it is also possible to make reference to drive information of preceding N times (N≧2).

By application of the reset pulse voltage Vr(n) including the correction value, in the reset period, it is possible to not only uniformize the particle position at each pixel to the initial (black) state but also set the residual DV voltage component value to a constant value. As a result, a gradation level controllability at each pixel is improved, and thus a resultant display characteristic is improved.

Embodiment 2

In this embodiment, the same display apparatus as in Embodiment 1 is used. Correction operation (drive) of the residual DC voltage component is effected by controlling a voltage value of a writing pulse voltage. As a result, it is possible to effect writing in view of the residual DC voltage component, so that a desired signal can be applied between upper and lower ends of the dispersion liquid portion.

Hereinbelow, a specific display method of the electrophoretic display device will be described with reference to FIG. 8.

Figure 8:
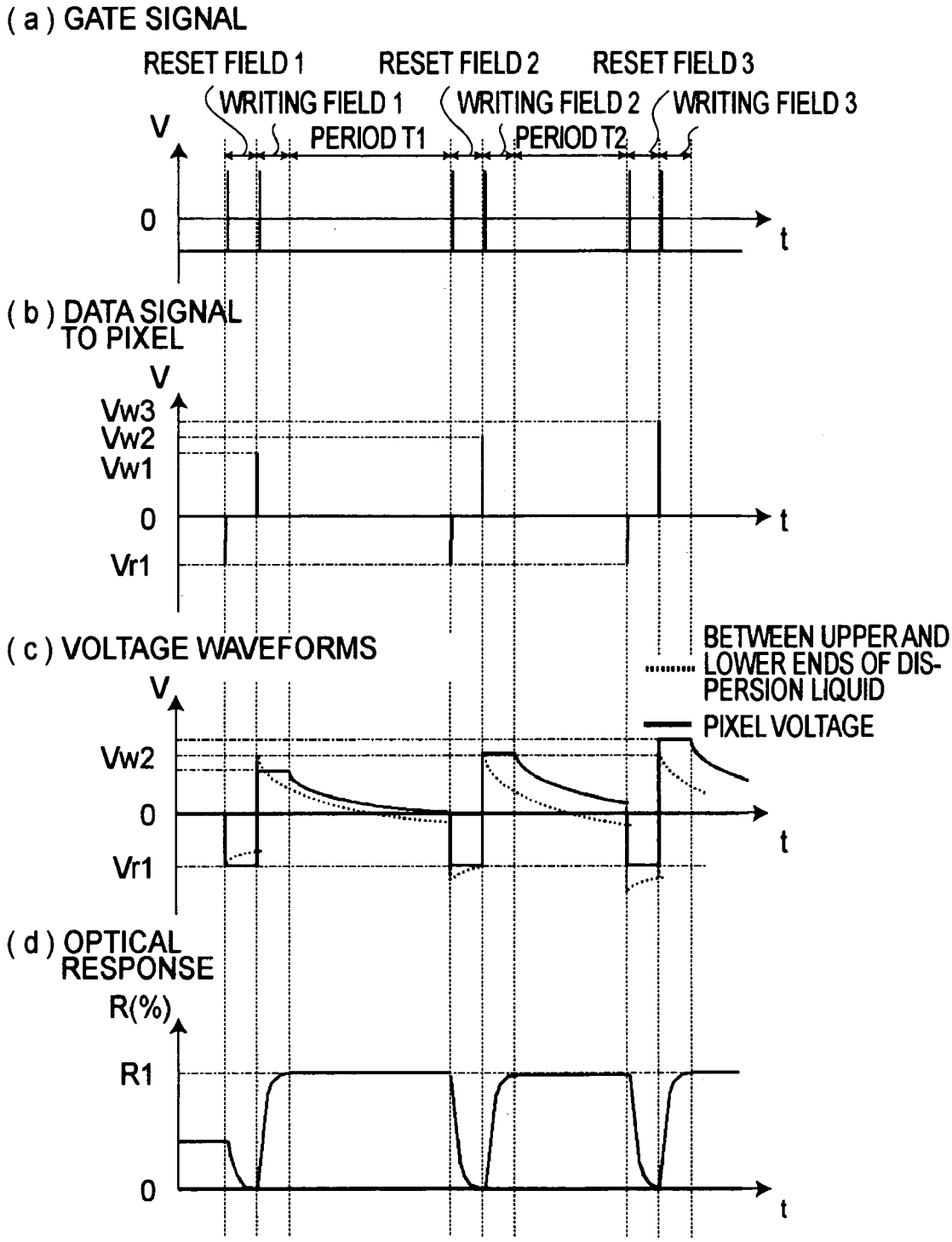
FIGS. 8(*a*) to 8(*d*) are views for illustrating signal waveforms and optical response with respect to a certain pixel of an electrophoretic display device used in the display apparatus according to the present invention.

Signal waveforms and optical response with respect to a certain (one) pixel of the electrophoretic display panel 38 in the case where the gradation control and the correction operation (drive) of the residual DC voltage component are effected at the same time are shown in FIG. 8, wherein a scanning signal pulse inputted from the gate driver is shown in FIG. 8(*a*), an information (data) signal pulse inputted from the source driver to the pixel is shown in FIG. 8(*b*), a pixel electrode voltage waveform an a voltage waveform applied between upper and lower ends of the dispersion liquid at the pixel are shown in FIG. 8(*c*), and a corresponding optical response is shown in FIG. 7(*d*).

First of all, in a reset field 1, a reset pulse voltage vr1 is applied from the source driver in synchronism with the gate pulse. In this case, such an assumption that a positional state of the particles and a value of residual DC voltage component can also be controlled as constant state and value, respectively. Therefore, in a writing field 1, Vw is applied to effect writing. Then, in a period T1, the voltage is gradually attenuated. In this embodiment, this attenuation is caused by gradual dissipation of electric charges due to OFF resistance of the TFT. Similarly, vr2 is applied in a reset field 2, Vw2 is applied in a writing field 2, and the voltage is gradually attenuated in a period T2. A similar operation is repeated also with respect to Vr3, Vw3 and T3.

In this embodiment, a desired gradation level (reflectance) is R1.

The gradation level of the display apparatus in this embodiment is dominantly determined by a voltage applied between upper and lower ends of the dispersion liquid portion. Accordingly, a writing pulse voltage Vw(n) is determined so that the voltage applied between upper and lower ends of the dispersion liquid portion is a predetermined value. At this time, the writing pulse voltage Vw(n) is determined while taking the residual DC voltage component into consideration. The residual DC voltage component can be estimated by reference to a writing history.

A writing pulse data is created by the graphic controller 31, on the basis of image data of the immediately preceding image information memory 34 and data of the controller 35 of elapsed time from display of immediately preceding image, and is applied as a writing pulse voltage Vw(n) from the source driver through the panel controller 33. The pulse data for the writing pulse voltage Vw(n) is determined by using a data conversion table prepared through experimental data. For example, by the use of the data conversion table, Vw2 is determined by reference to Vw1 and T1, and Vw3 is determined by reference to Vw2 and T2.

The preceding writing pulse voltage Vw(n−1) to be referred to is reproduced from data stored in an immediately preceding image information memory. At this time, the writing pulse voltage Vw(n) is determined according to the following equation, similarly as in Embodiment 1, by reading an elapsed time from the immediately preceding writing from the elapsed time controller.

$$Vw(n)=Vw+Vw(n-1)\times G\{T(n-1)\},$$

wherein Vw represents a voltage value determined based on an inputted image, Vw(n−1) represents an immediately preceding writing voltage, G{T(n−1)} represents a function of an elapsed time T(n−1) from the immediately preceding writing.

The thus corrected writing voltage Vw(n) is applied to the signal lines.

The value of the corrected writing voltage Vw(n) is used as a reference data for a subsequent writing, so that it is digitalized in each case and stored in the image information memory as a corrected image data. At that time, the corrected image data, for preceding writing, already stored in the memory is not necessary for current writing, thus being detected from the memory. However, if the writing history for preceding two or more writing operations is required, the corrected image data for the corresponding writing operations are still stored and retained in the memory.

As described above, the correction of residual DC voltage component using the writing pulse voltage in this embodiment is effected in such a manner that a writing pulse voltage is corrected by using a data conversion table which is determined in advance from an immediately preceding writing voltage and an attenuation time of TFT driving voltage after the writing. In order to enhance an accuracy of the writing pulse voltage Vw(n), it is also possible to make reference to drive information of preceding N times (N≧2).

By application of the writing pulse voltage Vw(n) including the correction value for the residual DC voltage component, it is possible to control the value of voltage applied between upper and lower ends of the dispersion liquid portion at each pixel. As a result, a gradation level controllability at each pixel is improved, and thus a resultant display characteristic is improved.

Embodiment 3

In this embodiment, a driving method of the display apparatus is effected in the same manner as in Embodiment 2 except that the resetting operations are not effected. More specifically, a writing pulse voltage is determined by reference to an immediately preceding display state (writing history), whereby it becomes possible to effect writing while taking into consideration of the residual DC voltage component. As a result, a desired signal can be applied between upper and lower ends of the dispersion liquid portion.

According to the driving method in this embodiment, it becomes possible to control a value of voltage applied between upper and lower ends of the dispersion liquid portion at each pixel. As a result, a gradation level controllability at each pixel is improved, so that a display characteristic is improved.

Embodiment 4

In the case where the period T(n) is a longer period in Embodiments 1 to 3, there arises burning due to standing of the display apparatus for a long time in some cases. In such cases, writing is adversely affected by not only the residual DC voltage component but also the burning due to the long-time standing.

In this embodiment, writing is performed by reference to also the period T(n), so that it becomes possible to effect writing in view of the residual DC voltage component and the burning due to the long-time standing. Thus, it is possible to obtain a desired display state.

According to the driving method in this embodiment, it is possible to effect not only the correction of the DC voltage component but also the correction on the burning due to the long-time standing. As a result, a gradation level controllability and a display characteristic of the electrophoretic display device are improved.

What is claimed is:

1. A display apparatus, comprising:

a matrix display panel including a display device having a memory characteristic and scanning lines and signal lines disposed so as to form pixels each at an intersection of the scanning and signal lines, and a drive circuit for applying voltages to the scanning and signal lines, said drive circuit generating a reset voltage and a signal voltage derived from an image data inputted externally and applying the reset and the signal voltage to the signal lines while sequentially applying a selection voltage to the scanning line to effect writing of an image in said display panel, wherein said drive circuit has a function of correcting the reset voltage or the signal voltage of an image data inputted externally in current image writing by adding a value depending on the signal voltage in preceding image writing and an elapsed time from the preceding image writing, and applying the corrected reset voltage or the corrected signal voltage to the signal lines.

2. An apparatus according to claim 1, wherein the signal voltage depending on an image data inputted externally comprises a reset voltage and a writing voltage, and said drive circuit corrects a reset voltage in current image writing on the basis of a signal voltage in preceding image writing and an elapsed time from the preceding image writing.

3. An apparatus according to claim 2, the reset voltage is corrected so that a DC voltage component effectively applied to a pixel at the time of completion of application of the reset voltage is substantially constant.

4. A driving method of a display apparatus according to claim 3, wherein the corrected reset voltage is a sum of a minimum pulse voltage capable of initializing a display state from an arbitrary gradation level and a voltage which is set so that a DC voltage component effectively applied to a display device portion at the time of image writing is substantially constant.

5. An apparatus according to claim 1, wherein the signal voltage depending on the externally inputted image data comprises a reset voltage and a writing voltage, and the drive circuit corrects a writing voltage in current image writing on the basis of a signal voltage in preceding image writing and an elapsed time from the preceding image writing.

6. An apparatus according to claim 5, wherein the writing voltage is corrected so that a DC voltage component effectively applied to a pixel at the time of completion of application of the writing voltage is substantially constant.

7. A driving method of a display apparatus according to claim 6, wherein the corrected writing voltage is a sum of a writing voltage determined depending on the externally inputted image data and a voltage which is set so that a DC voltage component effectively applied to a display device portion at the time of image writing is substantially constant.

8. An apparatus according to claim 1, wherein said drive circuit includes a circuit for memorizing the signal voltage applied to the signal lines at the time of image writing in at least a period until subsequent image writing is effected.

9. An apparatus according to claim 1, wherein said drive circuit includes a circuit for measuring the elapsed time from the preceding image writing.

10. An apparatus according to claim 1, wherein the signal voltage in preceding image writing is a signal voltage in immediately preceding image writing.

11. An apparatus according to claim 1, wherein the signal voltage in preceding image writing is a signal voltage in image writing of preceding N times (N>2).

12. An apparatus according to claim 1, wherein a display state of said display panel is determined depending on a polarity of a voltage applied to pixels.

13. A driving method of a display apparatus which comprises a matrix display panel including a display device having a memory characteristic and scanning lines and signal lines disposed so as to form pixels each at an intersection of the scanning and signal lines, and a drive circuit for applying voltages to the scanning and signal lines; said driving method comprising:

a step of generating a reset voltage and a signal voltage derived from an image data inputted externally in the drive circuit, and a step of effecting image writing to the display panel by applying the reset voltage and the signal voltage to the signal lines while sequentially applying a selection voltage to the scanning line to effect writing of an image in said display panel, to said display panel, wherein such an image writing step includes a step of correcting the reset voltage or the signal voltage in current image writing by adding a value depending on the signal voltage in preceding image writing and an elapsed time from the preceding image writing; and a step applying the corrected reset voltage or the corrected signal voltage to the signal lines.

* * * * *